US008500925B2

(12) United States Patent
Kaptay et al.

(10) Patent No.: US 8,500,925 B2
(45) Date of Patent: Aug. 6, 2013

(54) METHOD TO PRODUCE MONOTECTIC DISPERSED METALLIC ALLOYS

(75) Inventors: György Kaptay, Miskolc (HU); István Budai, Debrecen (HU)

(73) Assignees: Bay Zoltán Alkalmazott, Miskolc (HU); Kutatási Közalapítvány Nanotechnológiai Kutatóintézete, Miskolc (HU)

( * ) Notice: Subject to any disclaimer, the term of this patent is extended or adjusted under 35 U.S.C. 154(b) by 247 days.

(21) Appl. No.: 13/060,135

(22) PCT Filed: Aug. 27, 2009

(86) PCT No.: PCT/HU2009/000080

§ 371 (c)(1),
(2), (4) Date: Mar. 29, 2011

(87) PCT Pub. No.: WO2010/023494

PCT Pub. Date: Mar. 4, 2010

(65) Prior Publication Data

US 2011/0185855 A1 Aug. 4, 2011

(30) Foreign Application Priority Data

Aug. 27, 2008 (HU) ..... 0800532

(51) Int. Cl.
*C22C 1/02* (2006.01)
*C22C 1/06* (2006.01)

(52) U.S. Cl.
USPC ..... 148/400; 420/590; 75/708

(58) Field of Classification Search
USPC ..... 420/590; 148/400
See application file for complete search history.

(56) References Cited

U.S. PATENT DOCUMENTS

| | | | | |
|---|---|---|---|---|
| 5,221,324 | A * | 6/1993 | Jin et al. | 75/415 |
| 5,333,672 | A | 8/1994 | Gelfgat et al. | |
| 5,400,851 | A | 3/1995 | Prinz et al. | |
| 6,500,583 | B1 * | 12/2002 | Ting et al. | 429/218.2 |
| 2006/0065330 | A1 | 3/2006 | Cooper et al. | |

FOREIGN PATENT DOCUMENTS

| | | | |
|---|---|---|---|
| GB | 2 354 472 | A | 3/2001 |
| WO | WO 2009/101394 | * | 8/2009 |

OTHER PUBLICATIONS

"Al (Aluminum) Binary Alloy Phase Diagrams", Alloy Phase Diagrams, vol. 3, ASM Handbook, ASM International, 1992, p. 2.4-2.56.*

* cited by examiner

*Primary Examiner* — George Wyszomierski
*Assistant Examiner* — Tima M McGuthry Banks
(74) *Attorney, Agent, or Firm* — Jason D. Voight

(57) ABSTRACT

The invention relates to a method for producing monotectic alloys with finely dispersed and homogeneously distributed second phase particles from two or more starting metals or alloys, in which the two or more metals or alloys are melted together or separately and the two or more, practically immiscible liquid metallic alloys are mixed to disperse the alloy of lower volume ratio with the other alloy of higher volume ratio, then the system is cooled below the eutectic temperature. The characteristic feature of the method is that at least one of the starting alloys contains stabilizing solid particles.

17 Claims, 7 Drawing Sheets

Figure 1:
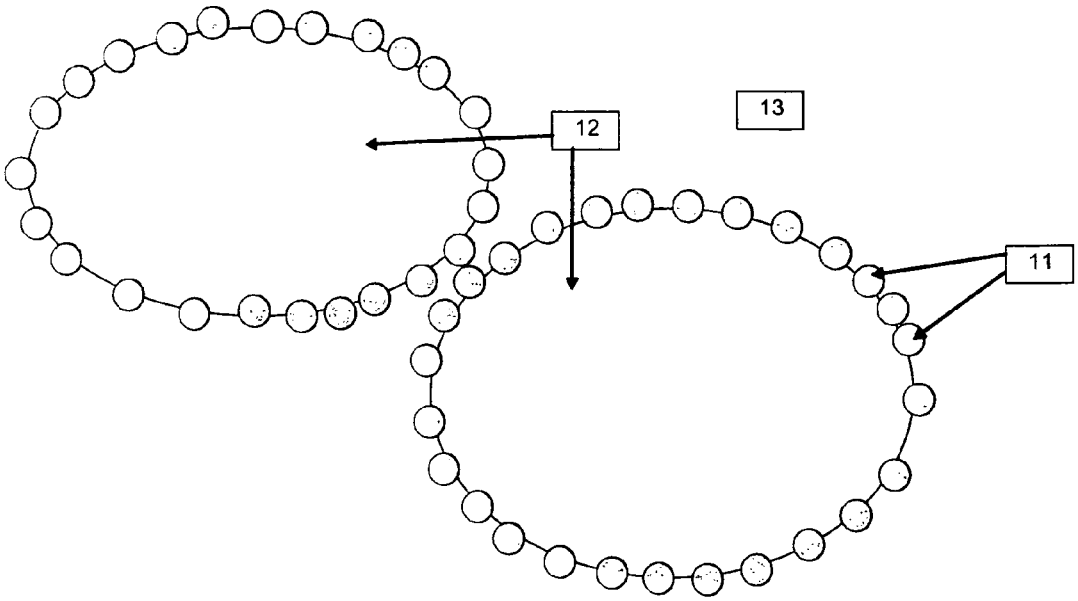

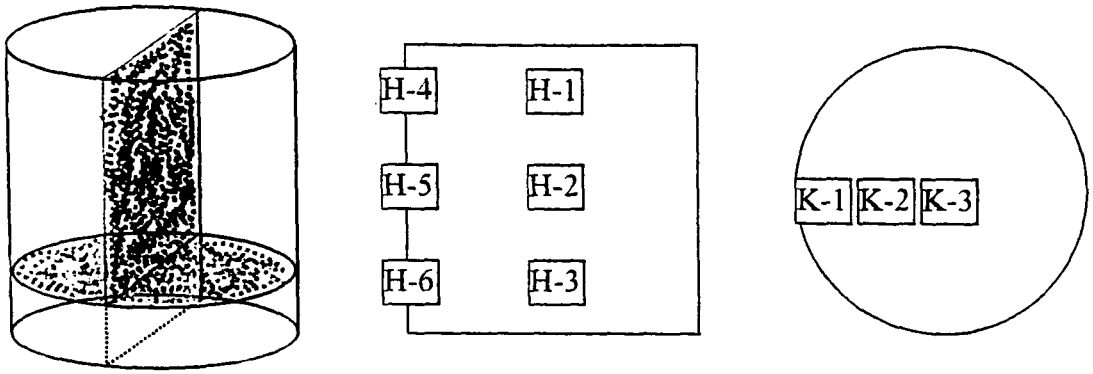
Fig. 3
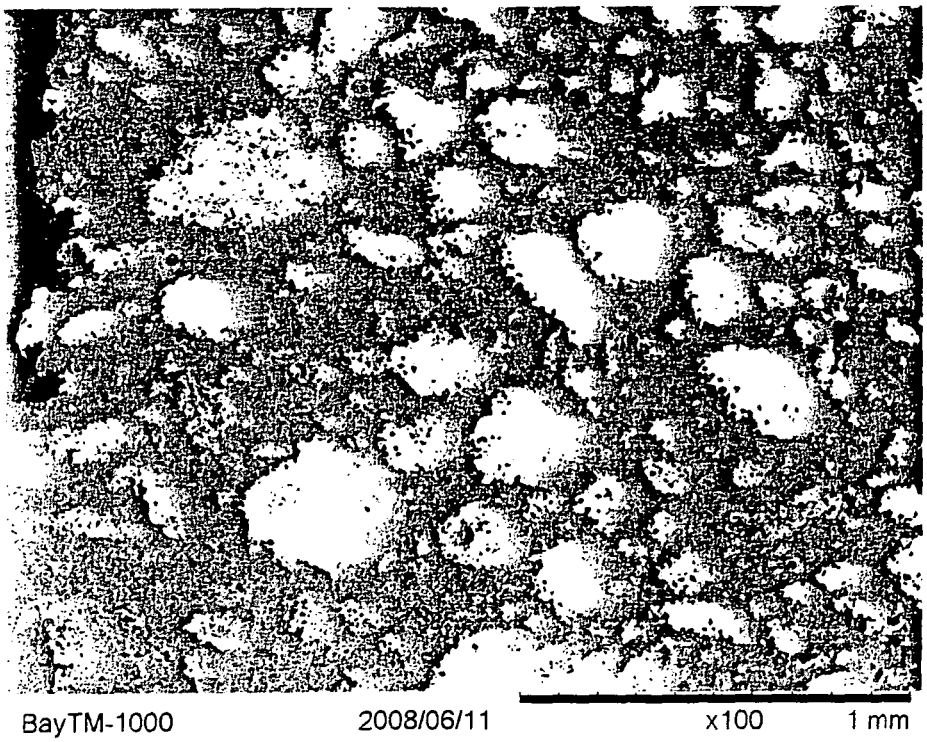
Fig. 4.1

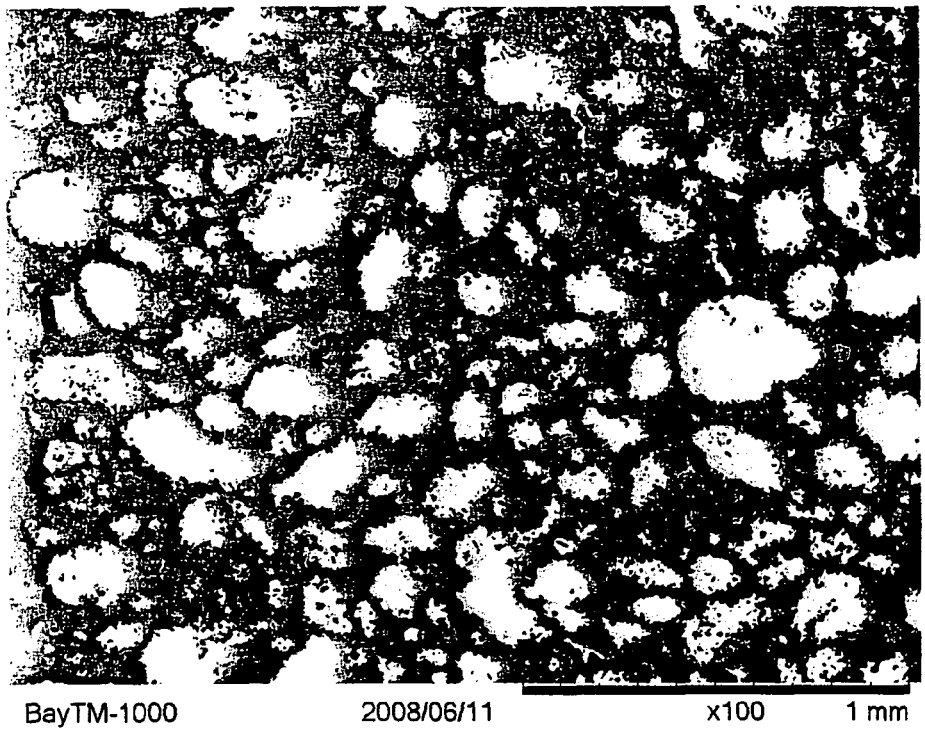
Fig. 4.2
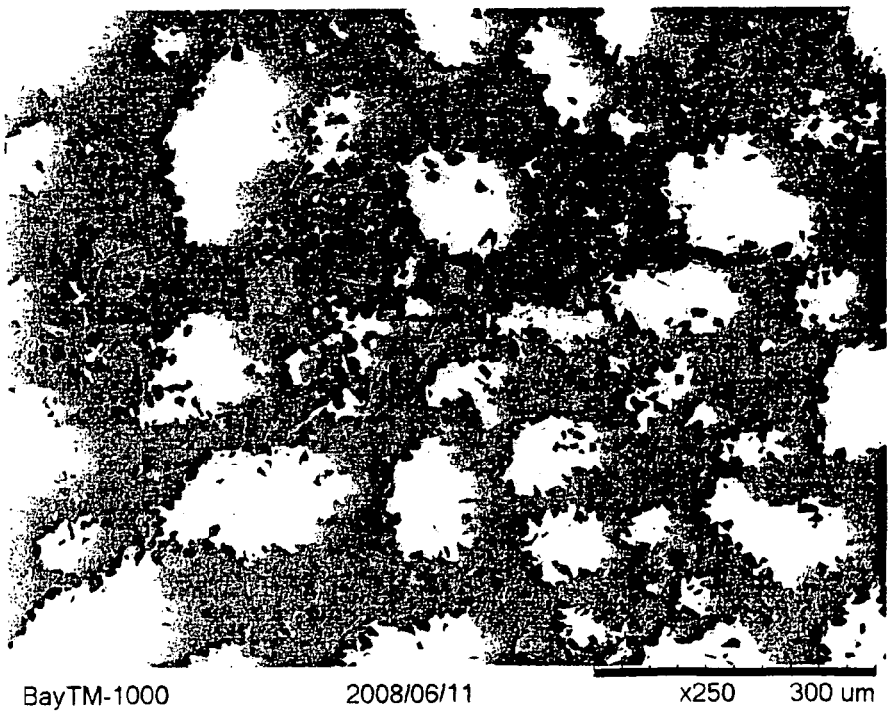
Fig. 4.3

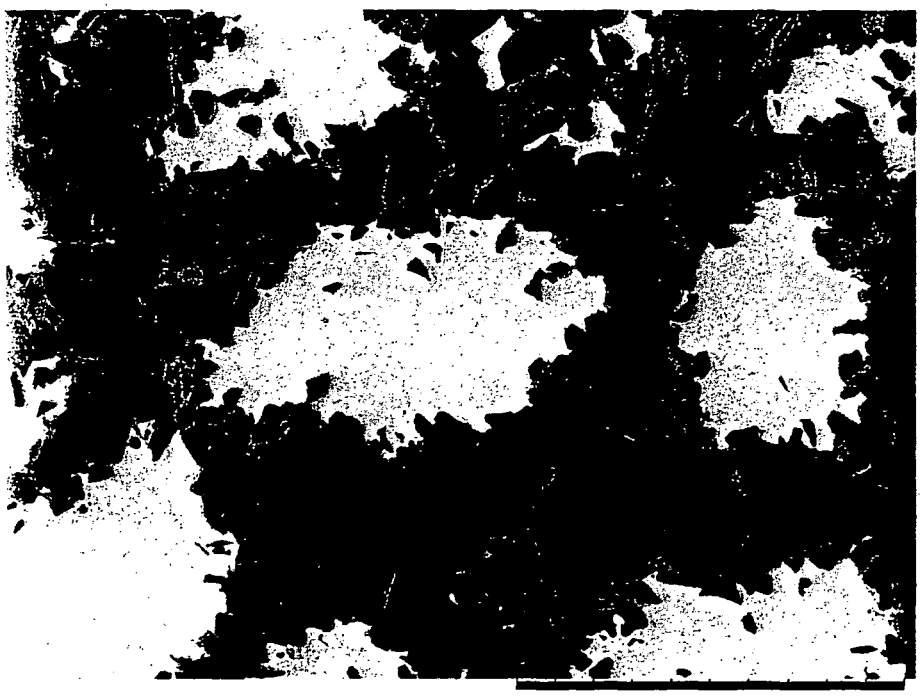
Fig. 4.4

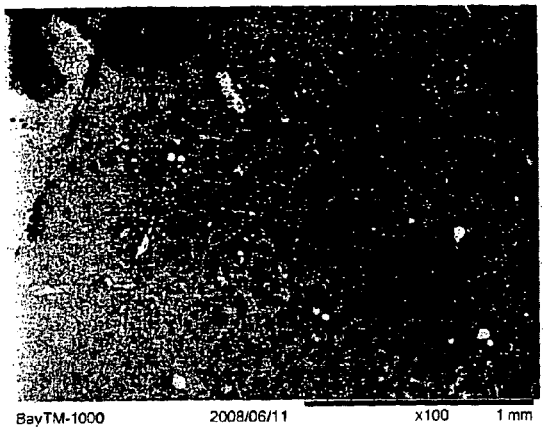
Fig. 5.a
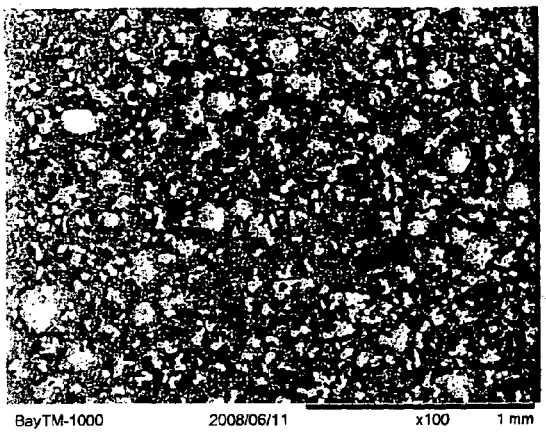
Fig. 5.b
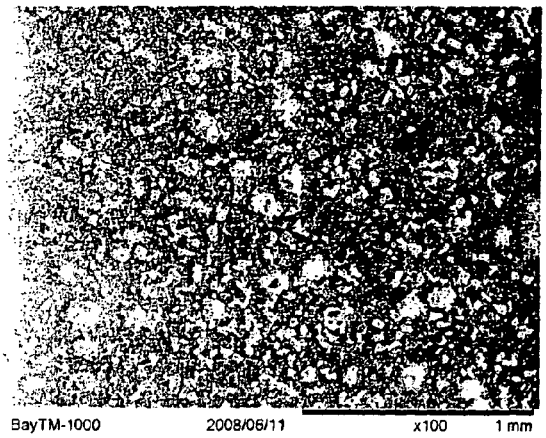
Fig. 5.c
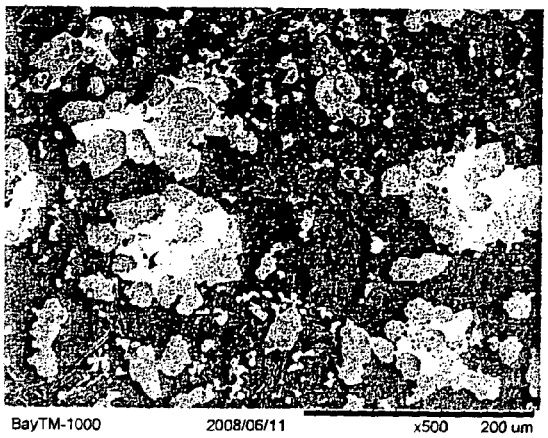
Fig. 5.d

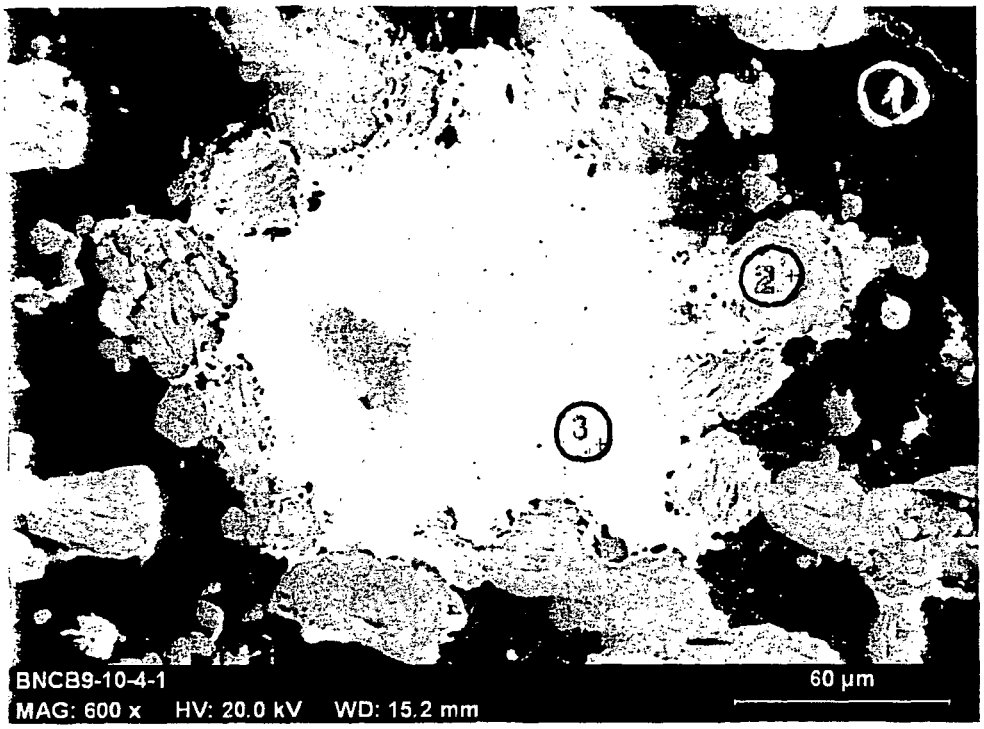
Fig. 6.1
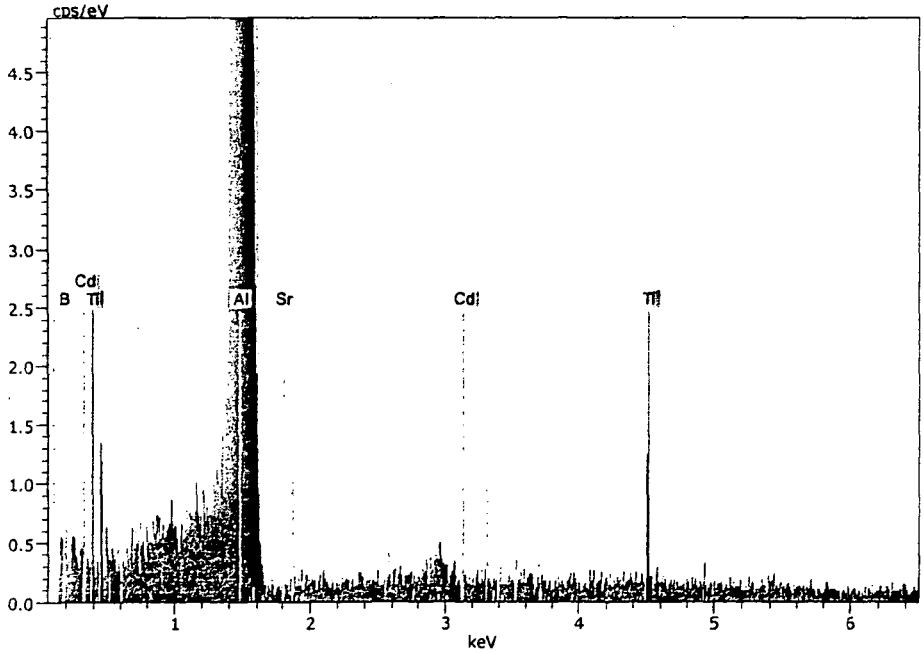
Fig. 6.2

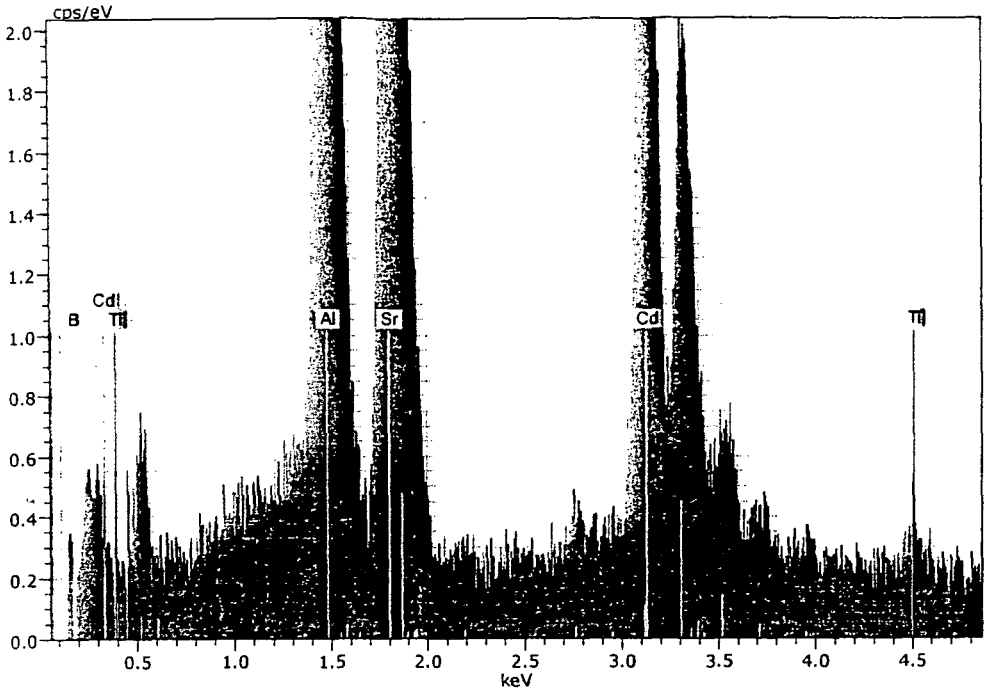
Fig. 6.3
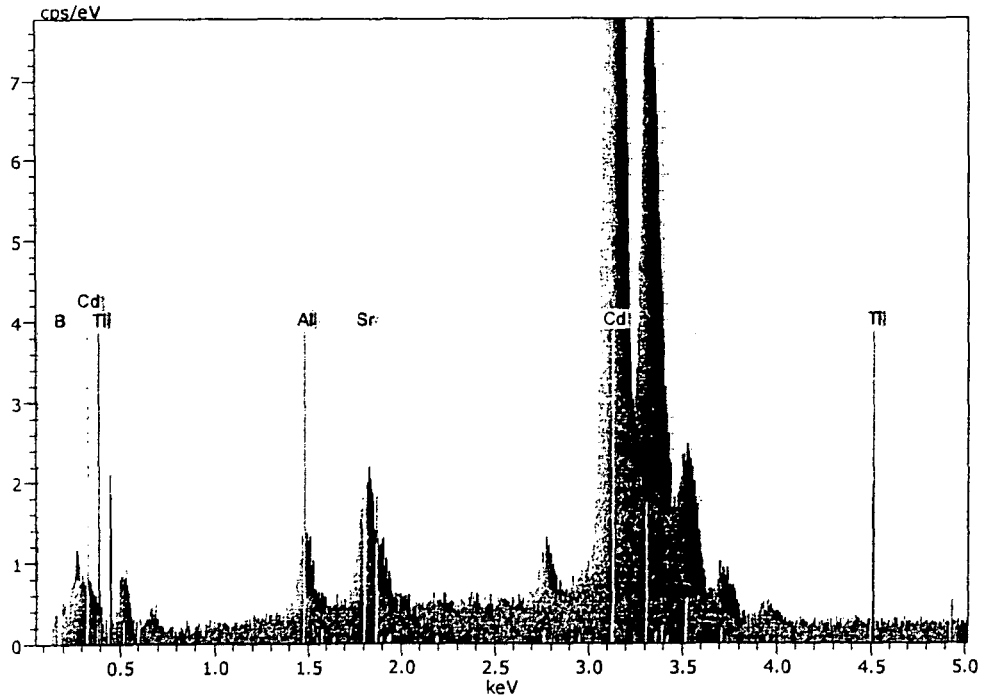
Fig. 6.4

METHOD TO PRODUCE MONOTECTIC DISPERSED METALLIC ALLOYS

This is the National Stage of International Application PCT/HU2009/000080, filed Aug. 27, 2009.

FIELD OF THE INVENTION

This invention relates to the production of monotectic dispersed metallic alloys with homogeneous distribution from two immiscible metals or their alloys.

BACKGROUND OF THE INVENTION

Metallic alloys are called monotectic alloys that form at higher temperatures two immiscible liquid metallic phases. Upon cooling below the monotectic temperature, at first one of the liquid phases, then below the eutectic temperature, the other liquid phase is solidified and in this way a solid monotectic alloy is obtained. Usually two macroscopic layers are formed on each other, due to the density difference between the two liquid phases.

Monotectic alloys such as Al—Pb, Cu—Pb, Al—Bi, Al—In and others are applied in different technological fields, such as bearing alloys or high-temperature super-conductors. Monotectic alloys would offer their best performance if one of the phases would be dispersed as small droplets in a homogeneous way in the other phase (called matrix). The smaller is the size and the more homogeneous is the distribution of the dispersed phase, the better are the expected properties of monotectic alloys. However, this requirement is opposed by the presence of the interfacial energy between the phases, making the droplets coalesce and by the density difference between the two liquid layers, making the layers vertically separate (sediment) with a velocity being higher for a higher droplet size. These effects are enhanced by the effect of the interfacial gradient force (Marangoni force), generally pulling the droplets towards places with higher temperatures, if there is any temperature gradient in the system. Nevertheless, freezing liquid alloys without a temperature gradient is impossible, thus the latter effect also acts against the homogeneous distribution of droplets [J. Z. Zhao, S. Drees and L. Ratke: Strip casting of Al—Pb alloys—a numerical analysis, *Mater. Sci. and Eng.*, A282, 262-290 (2000); G. Kaptay: On the temperature gradient induced interfacial gradient force, acting on precipitated liquid droplets in monotectic liquid alloys, *Materials Science Forum,* 508, 269-274 (2006)].

Due to the above circumstances, the key for producing monotectic alloys is the stabilization of dispersed droplets to prevent their coalescence and sedimentation. The ways known in the literature to produce monotectic alloys with homogeneous distribution of the second phase are summarized below.

Fast Cooling and Freezing

If a system of two immiscible liquid alloys is mixed at a high rotational speed with a special mixer, a system consisting of the dispersed droplets can be formed. If this system is quickly frozen, the dispersed droplets are frozen and in this way a monotectic alloy with homogeneous distribution can be obtained. Using this technology an ideally homogeneous distribution of the droplets can never be achieved, but this ideal situation can be approached by increasing the speed of mixing and freezing.

Such a technology is described by the following literature sources for the Al—Pb system: T. Ikeda, S. Nishi and T. Yagi: Manufacture of homogeneous ingots of Al—Pb alloy by casting in a movable metal mold with water spraying, *J. Japan Inst Metals,* 50, 98-107 (1986); A. Mohan, V. Agarwala and S. Ray: Dispersion of liquid lead in molten aluminium by stirring, Z. Metallkunde, 80, 439-443 (1989); Y. C. Suh and Z. H. Lee: Nucleation of liquid Pb-phase in hypermonotectic Al—Pb melt and the segregation of Pb-droplets in melt-spun ribbon, *Scripta Metall. et Materialia,* 33, 1231-1237 (1995).

Berrenberg casted the monotectic alloy into a thin film at a high speed to increase the cooling rate [Th. Berrenberg: The dispersion of Pb precipitates in rapidly solidified AlPb coatings in: "*Immiscible Liquid Metals and Alloys*", L. Ratke—DGM Verlag, 1993, 299-310].

Ichikawa et al. kept to mix the Al/Pb alloy even in the liquid/solid mushy zone [K. Ichikawa and S. Ishizuki: Production of leaded aluminum alloys by rheocasting, *J. Japan Inst Metals,* 49, 1093-1098 (1985)].

Prinz et al. casted the liquid alloy onto a moving strip or wire having a high ability to remove heat [B. Prinz and A. Romero: Process of producing monotectic alloys, U.S. Pat. No. 5,400,851 (1985)].

Bohling ensured mixing using a high-pressure melting head [P. Bohling: Verfahren zur Herstellung monotektischer Legierungen mittels statischem Mischer, German Offenlegungsschrift No. 197 12 015 (1998)].

Roósz et al. used a beam of high energy intensity for melting and intensive cooling of the substrate [A. Roósz, J. Sólyom, G. Buza and Z. Kálazi: Eljárás monotektikus ötvözetböl álló munkafelülettel ellátott fém munkadarabok elöállítására (Process for preparing metallic work-pieces provided with a work-surface of monotectic alloy), Hungarian patent No. 223,610 (2004)].

Melting and Freezing in Low-Gravity Environment

When melting and freezing are performed in a low gravity field, sedimentation does not take place, although the Marangoni force is still active. The cost of this technology is obviously very high, moreover it does not lead to perfect results due to the Marangoni convection.

Such experiments were performed by Andrews et al. in the Cu—Pb—Al system during a NASA parabola flight [J. B. Andrews, A. C. Sandler and P. A. Curreri: Influence of gravity level and interfacial energies on dispersion-forming tendencies in hypermonotectic Cu—Pb—Al alloys, *Metal Trans. A,* 19A, 2645-2650 (1988)] and also Liu et al. for the Fe—Sn alloy using a drop tube [X. Liu, X. Lu and B. Wei: Rapid monotectic solidification under free fall condition, *Science in China Ser. E, Engineering and Materials Sciences,* 47, No. 4, 1-12 (2004)].

Application of the Lorentz-Force to Prevent Sedimentation

If electric current is passed through a conductor, such as a liquid metallic alloy, in a magnetic field, then a so-called Lorentz force compensating the gravitational force acts on the droplets, and so in an ideal case a quasi gravity-free environment is created which prevents the sedimentation of the droplets.

Uffelmann et al. applied this technique for the Al—Pb system, without significant results [D. Uffelmann, L. Ratke and B. Feuerbacher: Lorentz-force stabilization of solid-liquid and liquid-liquid dispersions in: "*Immiscible Liquid Metals and Alloys*", L. Ratke—DGM Verlag, pp. 251-258 (1993)]. The main reason of the failure was the appearance of the Marangoni force pulling the droplets towards the temperature gradient, which eventually lead to inhomogeneous droplet distribution and the coalescence of the droplets.

As a conclusion it can be stated that none of the methods known till now allows the production of monotectic alloys of optional thickness with a homogeneous distribution of the second phase.

SUMMARY OF THE INVENTION

The object of the present invention is to develop a technology allowing to produce monotectic dispersed alloys of optional thickness with a homogeneous distribution of the second phase without applying fast cooling.

The basis of the invention is the recognition that an emulsion formed from two or more immiscible alloys can be stabilized by adding solid particles insoluble in any of the liquid alloys.

A further basis of the invention is the recognition that the maximum diameter of such solid particles should be not higher than half of the equivalent diameter of the droplets formed from the liquid alloy of smaller volume ratio.

A further basis of the invention is the recognition that such solid particles can be formed in situ from the liquid alloys.

Finally the basis of the invention is the recognition that after freezing the emulsion of two or more liquid alloys stabilized by solid particles that are insoluble in any of the liquid alloys, a monotectic alloy with fine and homogeneously distributed second phase can be obtained.

DETAILED DESCRIPTION OF THE INVENTION

Based on the above this invention is a method for producing monotectic dispersed alloys at least from two immiscible metals or alloys wherein two or more starting metals or alloys are melted together or separately and the thus-formed two or more practically immiscible melted alloys are mixed so as to disperse the phase of smaller volume ratio into the phase of larger volume ratio and finally this system is cooled below the eutectic temperature. According to this invention at least one of the starting metals or alloys applied should contain stabilizing solid particles during the mixing process. These particles are solid at the temperature of production, are practically insoluble in the liquid alloys used and their maximum equivalent diameter is smaller than half of the average equivalent diameter of the metallic droplets formed from the liquid alloy of smaller volume ratio. These stabilizing solid particles can preferably be produced in situ from the liquid alloys during the production. This way a monotectic alloy is obtained with homogeneous distribution of the second phase.

Aluminium-, silicon-, carbon- and/or strontium-containing compounds should be preferably used as stabilizing particles. A preferred silicon- and carbon-containing compound is silicon carbide (SiC), while a preferred aluminium- and strontium-containing compound is the aluminium stroncide ($Al_4Sr$). The aluminium stroncide is preferably produced from the liquid alloy during mixing.

A primary requirement in relation to the stabilizing particles is that they should not be considerably soluble in any of the liquid alloys. A further requirement is that they should not have negative influence on the properties of the final alloy.

Cooling of the system from the liquid state can be performed by any cooling rate. Preferably the cooling is performed as a spontaneous slow cooling due to the lower temperature of the environment.

According to the invention, solid stabilizing particles of suitably chosen composition and size are used to stabilize the liquid metallic droplets in the liquid alloy.

The basis of stabilisation is that the stabilizing particles are positioned at the interface between the droplets and the liquid matrix, and in case of contact of two droplets they stabilize the thin liquid metallic film (schematically see FIG. 1). It seems probable that this stabilization is induced partly due to interfacial forces, partly due to increased local viscosity caused by the presence of the solid particles. Coalescence of the droplets is taking place neither under the influence of gravity and density difference, nor due to the Marangoni force, as the interfaces of the droplets are stabilized by the particles.

After melting of two or more metals strong mixing is performed. Due to mixing the liquid metal of lower volume ratio is dispersed in the other immiscible liquid alloy, while the stabilizing solid particles concentrate at the interface of the two liquid alloys. When mixing is terminated the latter particles stabilize the liquid metallic emulsion, that is the dispersed droplets do not coalesce even during a longer stay in liquid state or during slow cooling. The stabilizing particles can be added separately to the starting liquid metals or can be present in one of them or can be formed during the process.

When the desired size of the dispersed droplets is known, the maximum diameter of the stabilizing particles should be selected by approximately 2-100 times lower as compared to the average equivalent diameter of the droplets to be stabilized. This is because the stabilizing particles should surround the droplets to be stabilized, and this is possible only if their size is smaller than that of the droplets (see schematic FIG. 1).

Figure 2:
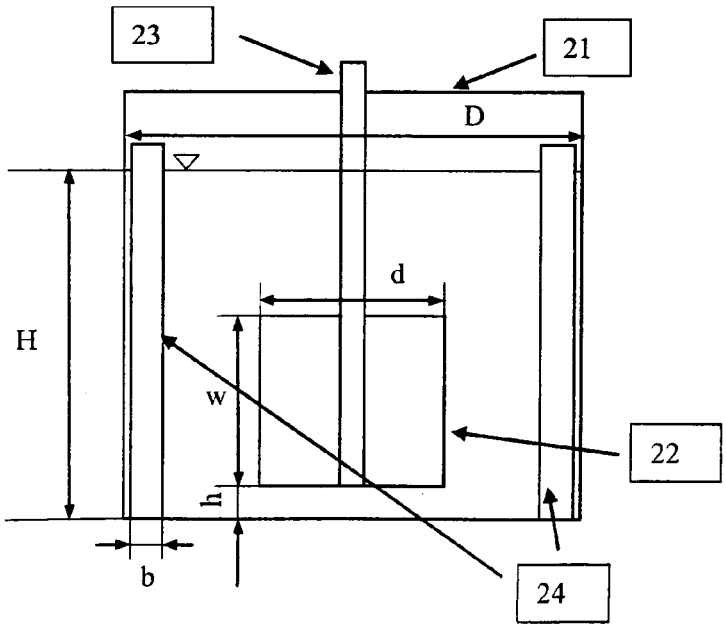

Other details of the invention are described with the aid of figures as follows:

FIG. 1. is a schematic drawing of the liquid metallic emulsion stabilized by solid particles, FIG. 2 shows the geometrical ratios of the mixing crucible (pot) and the mixing propeller, FIG. 3 shows the micrographs made from longitudinal and perpendicular sections of the sample described in Example 1, FIG. 4.1 is a micrograph made with a 100fold magnification from section H5 of the longitudinal section (Example 1), FIG. 4.2 is a micrograph made with a 100fold magnification from section H2 of the longitudinal section (Example 1), FIG. 4.3 is a micrograph made with a 250fold magnification from section H2 of the longitudinal section (Example 1), FIG. 4.4 is a micrograph made with a 500fold magnification from section H2 of the longitudinal section (Example 1), FIG. 5 shows the micrographs made from four longitudinal cross-sections of the sample described in Example 2, FIG. 6.1 is a micrograph made with a 2000fold magnification from section K1 of the cross-section (Example 2), FIG. 6.2. shows the EDS spectrum of point 1 of FIG. 6.1, FIG. 6.3. is the EDS spectrum of point 2 of FIG. 6.1, FIG. 6.4. shows the EDS spectrum of point 3 of FIG. 6.1.

In FIG. 1 the stabilizing particles are denoted by 11, the dispersed liquid metallic droplets are denoted by 12, while the liquid metallic matrix is denoted by 13.

The determination of the amount of stabilizing particles can be performed by a single material balance. If the diameter and volume ratio of the droplets to be stabilized in the matrix are known, the amount of stabilizing particles can be calculated from the demand that preferably the surface of all droplets is covered by a mono-layer of particles. The amount of particles can also be expressed as the volume ratio any liquid phase since the particles can be added to the system either from outside or together with at least one of the liquid phases. This does not mean that for the stability of the emulsion the surface of all droplets should be covered by particles in a closely packed manner, or that some particles cannot be positioned within any of the liquid phases.

The more the shape of the solid particles deviates from that of the sphere, the less is the required volume fraction of the particles as in this case the solid particles can cover droplets with higher efficiency.

The ratio of the two metals or alloys should be in the monotectic region at the temperature of production. This monotectic region can be read from the phase diagram of the alloy. The ratio of metallic components is generally expressed in weight percent. The compositions of the two immiscible liquid alloys can be obtained from the phase diagram. From the known densities of the components the volume fractions of the two immiscible liquid alloys can also be calculated. During emulsification the dispersed phase is usually formed by that having lower volume fraction. The matrix is usually formed by the liquid metallic alloy with a higher volume fraction.

DESCRIPTION OF THE EXPERIMENTS

In order to simulate the mixing process, i.e. to check whether droplets can be indeed produced by the mixer in the melted matrix, model-experiments were performed in a stainless steel crucible.

To produce the emulsion a mixer with plane blades was applied. The blades were positioned parallel to the vertical axis of the mixer, while the characteristic direction of flowing was tangential. Four vertical breakers were built into the crucible in the full height of same to increase the shearing forces. The crucible was produced from two sections, so the solidified alloy could be easily removed. The equipment is shown in FIG. 2.

In FIG. 2 the crucible is denoted by 21, the mixing propeller is denoted by 22, the axis of the mixing propeller is denoted by 23, while the breakers are denoted by 24. The outer diameter of the mixing propeller is denoted by d, the inner diameter of the crucible is denoted by D, the height of the mixing propeller is denoted by w, the height of the liquid alloy within the crucible is denoted by H, the width of the breakers is denoted by b, while the distance between the bottom of the crucible and that of the mixing propeller is denoted by h.

Some preferred geometric ratios of the mixing equipment are as follows: d/D=0.4 to 0.5; w/d=0.9 to 1.0; h/d=0.1 to 0.2; H/d=1.5 to 2.0; b/D=0.1.

In the model experiments water was mixed with 23 vol % of mercury at different rotational speeds without any solid particles. These model liquids were selected for their high density difference and for transparency of water, so the mixing state was easy to observe. For control experiments the crucible was made of glass with identical geometry as that of the stainless steel crucible for real experiments. The propeller part of the mixer was made of graphite, while its axes were made of steel in both the real and model experiments.

During the model experiments we have found that below the rotational speed of 1,000 $min^{-1}$ water and mercury did not disperse in each other; mercury stayed at the bottom of the crucible, while water was mixed above it. At the rotational speed at and above 1,000 $min^{-1}$ mercury was lifted from the bottom of the crucible and it became dispersed in water in the whole volume of the crucible. It is important to note that the whole liquid system did not rotate along the inner periphery of the crucible due to the presence of the breakers. In the interval of the rotational speeds between 1,000 and 1,500 $min^{-1}$ the emulsion was homogeneous. However, at higher rotational speeds air was mixed into the system. As a result, bubbles appeared at the top of the emulsion. With further increase of the rotational speed the amount of bubbles within the emulsion increased and some mercury droplets flew out of the emulsion. On the other hand, when the rotational speed was decreased below 1,000 $min^{-1}$, the homogeneous emulsion immediately destabilized, i.e. mercury settled at the bottom of the crucible.

To produce liquid metallic emulsions, the mixing equipment with the following actual sizes was used: d=22 mm, D=44 mm, w=17 mm, h=3 min, H=30 to 38 mm, b=5 mm (see FIG. 2). The crucible was made of stainless steel to increase its lifetime.

A laboratory mixing machine and a computer-directed furnace were used for the experiments. The parameters of the furnace are as follows: maximum temperature: 1320° C.; temperature interval: 20 to 1320° C.; heating rate: 1 to 1,000° C./h; accuracy of temperature: ±5.0° C.

The experiments were performed according to the following algorithm:

i) The starting materials were placed into the crucible. The matrix was put on the bottom, while the dispersing phase was put on its top. The crucible was put into a cylindrical steel container to separate it from the furnace. The axe of the mixer and a water cooling jacket were put on the top of the cylindrical steel container.

ii) Heating was started at the heating rate of 350° C./h, the desired temperature of experiments was 650 to 670° C. Simultaneously with heating, the system was flushed with argon gas. During the first 10 minutes argon was added at a flow rate of 1 L/min, while during the rest of the experiments (till the sample is frozen) argon flow rate was kept at the level of 0.4 L/min iii) When the temperature of the experiment was reached, the system was kept at this temperature value during 60 minutes to melt the whole system. Then the mixer was introduced into the liquid system. The distance between the bottom of the crucible and the mixer was kept between 2 and 3 mm.

iv) Mixing was started at a rotational speed of 50 $min^{-1}$ during 20 minutes. Then the rotational speed was increased to 1,000 $min^{-1}$ and mixing was performed at this speed during 5 minutes. Then the mixer was stopped and removed from the crucible.

v) The system was taken out of the furnace and was let to cool spontaneously in a room-temperature air.

Longitudinal and a cross-sections were prepared from the solidified sample (schematically see FIG. 3). The cross-sections were immersed into a two-component Dentacryl resin (producer: Spofa Dental) and polished. Micrographs were made from the polished surface by a scanning electron microscope equipped with a microsonde of EDAX type that is able to determine the composition of elements from atomic number 5 to 92. In the back-scattered pictures the elements with lower atomic numbers such as Al (13) and Si (14) seem to be darker, while the elements with higher atomic numbers such as Pb (82) and Bi (83) seem to be white.

The main advantages of the process according to the invention are as follows:

i. Our method is able to stabilize two or more immiscible liquid metals with insoluble solid particles to produce the final monotectic alloy.

ii. The method ensures the production of monotectic alloys with finely dispersed and homogeneously distributed second phase.

iii. The method ensures the production of monotectic alloys with any thickness and of homogeneous distribution of the second phase.

iv. The method ensures the production of monotectic alloys with any thickness and of homogeneous distribution of the second phase without fast cooling.

The invention is characterized in more detail by the following examples.

Example 1

74.6% by vol. of the system was the metal matrix composite type F3S20S (Duralca®), with the main component aluminium+10% by weight of silicon (Si)+additional 20% by vol. of silicon carbide (SiC) particles. The average diameter of the SiC particles was 10 μm. The phase to be dispersed in the Al—Si liquid alloy amounted to 25.4. % by vol.; it was bismuth (Bi) (Aldrich, 99%, 100 mesh).

In FIG. 4.1 a micrograph made with a 100fold magnification from section H5 of the longitudinal section is shown. White areas are Bi-rich droplets, grey matrix is Al—Si-rich alloy, black points are SiC particles.

In FIG. 4.2 a micrograph made with a 100fold magnification from section H2 of the longitudinal section is shown. White areas are Bi-rich droplets, grey matrix is Al—Si-rich alloy, black points are SiC particles.

In FIG. 4.3 a micrograph made with a 250fold magnification from section H2 of the longitudinal section is shown. White areas are Bi-rich droplets, grey matrix is Al—Si-rich alloy, black points are SiC particles.

In FIG. 4.4 a micrograph made with a 500fold magnification from section H2 of the longitudinal section is shown. White areas are Bi-rich droplets, grey matrix is Al—Si-rich alloy, black points are SiC particles, light-grey areas are Si.

In the upper part of the longitudinal section there are no Bi droplets. In the middle section (see the side of FIG. 4.1 and the middle of FIG. 4.2) of the sample Bi-droplets stabilised by SiC particles can be observed. The picture taken from section H2 is shown with higher magnifications in FIGS. 4.3-4.4. One can see that the aluminium matrix contains some Si-precipitates and a large number of solidified Bi-droplets with an average diameter of 100 to 200 μm. The majority of SiC particles are positioned along the Bi droplet/Al-matrix interface, obviously preventing the coalescence of neighbouring Bi-droplets. One can see that the casting has a homogeneous macro-structure in its middle and bottom sections.

Example 2

One of the phases is the grain refinement alloy type KBM AFFILIPS, containing aluminium as main component+10% by weight of strontium (Sr)+1% by weight of titanium (Ti)+0.2% by weight of boron (B). In this alloy the components can form different solid intermetallic compounds such as $Al_4Sr$, $Al_3Ti$, $TiB_2$. 93% by vol. of this alloy was used in this example. The phase to be dispersed is cadmium (Cd) (Magyar Pénzverde, 99%), used in 7% by vol. in this example.

The longitudinal section from this sample is shown in FIG. 5 in different magnifications:

a) 100fold magnification at section H-1, b) 100fold magnification at section H-2, c) 100fold magnification at section H-3, d) 500fold magnification at section H-3.

In FIG. 6.1 a micrograph made with a 2000fold magnification from section K1 of the cross-section is shown. Point 1: Al-matrix, point 2: $Al_4Sr$ stabilizing particles, point 3: solidified Cd-droplet. FIGS. 6.2 to 6.4 show the EDAX spectra of points 1-3 of FIG. 6.1. From these spectra one can see that the matrix (point 1) of FIG. 6.1 contains mostly Al, the grey particles (point 2) of FIG. 6.1. contain mostly Al with some Sr, while the white droplet (point 3) of FIG. 6.1 contains mostly Cd. The grey particles (point 2 of FIG. 6.1) are most probably $Al_4Sr$ intermetallic compounds, in accordance with the binary Al—Sr phase diagram.

In the top section of the sample (FIG. 5.*a*) there are very few Cd-droplets. In the middle and bottom sections of the sample (FIGS. 5.*b*-*d*) there is a large number of Cd-rich droplets stabilized by particles precipitated from the liquid alloy. From the cross-section of FIG. 6.1 one can see that the particles almost fully cover the solidified Cd-droplets. As follows from FIG. 6.3 and from the Al—Sr phase diagram, the stabilizing particles are probably $Al_4Sr$ intermetallic particles.

In this case the size of the stabilizing particles continuously increases during production. As one can see from FIG. 6.1, the stabilizing particles are actually too large as compared to the size of the stabilized droplets. The size ratio of particles to droplets can be decreased by decreasing the production time.

The invention claimed is:

1. A method for producing monotectic dispersed alloys at least from two immiscible metals or alloys, said method comprising melting together or separately two or more starting metals or alloys to form two or more practically immiscible melted metals or alloys, mixing the two or more practically immiscible melted metals or alloys so as to create a dispersion of a phase of smaller volume ratio in a phase of larger volume ratio and cooling the dispersion below its eutectic temperature, wherein at least one of the practically immiscible melted metals or alloys contains stabilizing solid particles during the mixing, wherein the stabilizing solid particles remain solid at the temperatures of the method, are practically insoluble in the melted metals or alloys and have a maximum equivalent diameter which is not larger than half of an equivalent diameter of liquid metallic droplets formed from the phase of smaller volume ratio.

2. The method as claimed in claim 1, wherein the stabilizing solid particles are formed in situ from the melted metals or alloys during the process.

3. The method as claimed in claim 2, wherein compounds containing aluminium, silicon, carbon and/or strontium are used as stabilizing solid particles.

4. The method as claimed in claim 3, wherein silicon- and carbon-containing compounds are used as stabilizing solid particles.

5. The method as claimed in claim 3, wherein aluminium-stroncide ($Al_4Sr$) is used as aluminium- and strontium-containing stabilizing solid particles.

6. The method as claimed in claim 5, wherein aluminium-stroncide ($Al_4Sr$) formed in situ from the melted metals or alloys during the process is used.

7. The method as claimed in claim 1, wherein compounds containing aluminium, silicon, carbon and/or strontium are used as stabilizing solid particles.

8. The method as claimed in claim 7, wherein silicon- and carbon-containing compounds are used as stabilizing solid particles.

9. The method as claimed in claim 7, wherein aluminium-stroncide ($Al_4Sr$) is used as aluminium- and strontium-containing stabilizing solid particles.

10. The method as claimed in claim 9, wherein aluminium-stroncide ($Al_4Sr$) formed in situ from the melted metals or alloys during the process is used.

11. The method as claimed in claim 1, wherein the cooling is performed in surrounding air of room temperature at a slow cooling rate.

12. A method for producing monotectic dispersed alloys at least from two immiscible metals or alloys, said method comprising melting together or separately two or more starting metals or alloys to form two or more practically immiscible melted metals or alloys, mixing the two or more practically immiscible melted metals or alloys so as to create a dispersion of a phase of smaller volume ratio in a phase of larger volume ratio and cooling the dispersion below its eutectic temperature, wherein cooling is performed in surrounding air of room temperature at a slow cooling rate, wherein at least one of the practically immiscible melted metals or alloys contains stabilizing solid particles during the mixing.

13. The method as claimed in claim 12, wherein the stabilizing solid particles are formed in situ from the melted metals or alloys during the method.

14. The method as claimed in claim 12, wherein compounds containing aluminium, silicon, carbon and/or strontium are used as the stabilizing solid particles.

15. The method as claimed in claim 12, wherein aluminium-stroncide ($Al_4Sr$) is used as the stabilizing solid particles.

16. The method as claimed in claim 13, wherein compounds containing aluminium, silicon, carbon and/or strontium are used as the stabilizing solid particles.

17. The method as claimed in claim 13, wherein aluminium-stroncide ($Al_4Sr$) is used as the stabilizing solid particles.

* * * * *